US010154737B2

(12) United States Patent
Horst et al.

(10) Patent No.: US 10,154,737 B2
(45) Date of Patent: Dec. 18, 2018

(54) INFANT CARE APPARATUS

(71) Applicant: Wonderland Nurserygoods Company Limited, Kwai Chung, N.T. (HK)

(72) Inventors: Andrew J. Horst, West Lawn, PA (US); Ryan N. Miller, Lancaster, PA (US); Daniel A. Sack, Pottstown, PA (US); William B. Bellows, Wyomissing, PA (US); Curtis M. Hartenstine, Birdsboro, PA (US)

(73) Assignee: Wonderland Switzerland AG, Steinhausen (CH)

( * ) Notice: Subject to any disclaimer, the term of this patent is extended or adjusted under 35 U.S.C. 154(b) by 681 days.

(21) Appl. No.: 14/788,983

(22) Filed: Jul. 1, 2015

(65) Prior Publication Data

US 2016/0000232 A1 Jan. 7, 2016

Related U.S. Application Data

(60) Provisional application No. 61/998,593, filed on Jul. 2, 2014.

(51) Int. Cl.

| | |
|---|---|
| ***A47D 5/00*** | (2006.01) |
| ***A47D 7/00*** | (2006.01) |
| ***A47D 9/00*** | (2006.01) |

(52) U.S. Cl.

CPC ..... *A47D 9/00* (2013.01); *A47D 5/00* (2013.01); *A47D 7/00* (2013.01)

(58) Field of Classification Search

CPC . A47D 5/00; A47D 5/006; A47D 7/00; A47D 7/002; A47D 7/005; A47D 7/01;

(Continued)

(56) References Cited

U.S. PATENT DOCUMENTS 544,982 A * 8/1895 Hoskins ..... A47C 19/205 297/62
737,561 A * 9/1903 Arnold ..... A47C 19/20 5/314.1

(Continued)

FOREIGN PATENT DOCUMENTS

CN 2209909 Y 10/1995
CN 1383775 A 12/2002

(Continued)

OTHER PUBLICATIONS

An Office Action dated Jul. 26, 2017 from co-pending Chinese Patent Application No. 201510379467.6 (including translation as a seperate document).

*Primary Examiner* — Robert G Santos
(74) *Attorney, Agent, or Firm* — Daniel A. Tallitsch; Baker McKenzie LLP

(57) ABSTRACT

An infant care apparatus includes a support frame and an infant resting support rotationally connected with each other, and a first and a second latch. The infant resting support is provided with a first and a second bearing surface oriented in different directions, and has an angular position between a first and a second position, the first bearing surface facing upward in the first position, and the second bearing surface facing upward in the second position. The first latch can lock the infant resting support in the first and second positions. The second latch is switchable from a disengaged to an engaged state to stop the infant resting support in the angular position.

42 Claims, 15 Drawing Sheets

(58) Field of Classification Search
CPC . A47D 7/04; A47D 9/00; A47D 9/005; A47D 13/00; A47D 13/06; A47D 13/061; A47D 13/063; A47D 13/066
USPC ..... 5/655, 93.1, 93.2, 97, 98.1, 99.1
See application file for complete search history.

(56) References Cited

U.S. PATENT DOCUMENTS 1,920,580 A * 8/1933 McGlauthen ..... A47D 7/04 248/274.1
4,146,885 A 3/1979 Lawson, Jr.
4,882,799 A 11/1989 Shapiro
5,369,826 A 12/1994 Ikeda
6,173,462 B1 1/2001 Huang et al.
6,539,563 B1 4/2003 Hsia
6,594,840 B2 * 7/2003 Tomas ..... A47D 9/00 5/101
6,948,197 B1 * 9/2005 Chen ..... A47D 5/006 403/97
7,543,340 B2 * 6/2009 Kenny ..... A47C 17/84 5/118
7,908,686 B2 * 3/2011 Clapper ..... A47D 5/00 5/655
8,230,536 B2 * 7/2012 Clapper ..... A47D 5/00 5/655
8,925,128 B2 * 1/2015 Fiore, Jr. ..... A47D 9/005 5/655
8,973,180 B2 * 3/2015 Zeng ..... A47D 7/04 5/93.1
8,984,682 B2 * 3/2015 Zhao ..... A47D 5/006 5/100
9,089,225 B2 * 7/2015 Fiore, III ..... A47D 9/005
9,101,226 B1 * 8/2015 Hartenstine ..... A47D 5/006
9,198,524 B2 * 12/2015 Horst ..... A47D 7/01
9,364,098 B2 * 6/2016 Fiore, III ..... A47D 9/005
9,375,095 B2 * 6/2016 Fiore, Jr. ..... A47D 9/005
9,565,950 B2 * 2/2017 Horst ..... A47D 7/01
2002/0002741 A1 * 1/2002 Tomas ..... A47D 9/00 5/101
2006/0080776 A1 4/2006 Clapper et al.
2006/0130237 A1 * 6/2006 Clapper ..... A47D 5/00 5/655
2006/0225204 A1 10/2006 Bretschger et al.
2006/0225205 A1 10/2006 Troutman
2006/0253979 A1 11/2006 Chen
2007/0294822 A1 * 12/2007 Kenny ..... A47C 17/84 5/9.1
2008/0034506 A1 2/2008 Chen et al.
2009/0188039 A1 7/2009 Shan et al.
2011/0197356 A1 * 8/2011 Clapper ..... A47D 5/00 5/2.1
2012/0037869 A1 2/2012 Fiore, III et al.
2012/0037870 A1 2/2012 Fiore, Jr. et al.
2012/0204347 A1 8/2012 Li
2013/0047335 A1 2/2013 Zeng et al.
2014/0208503 A1 7/2014 Horst et al.
2015/0082538 A1 * 3/2015 Fiore, Jr. ..... A47D 9/005 5/93.1
2015/0173523 A1 * 6/2015 Horst ..... A47D 7/01 5/11
2015/0216321 A1 * 8/2015 Hartenstine ..... A47D 5/006 5/11
2015/0296999 A1 * 10/2015 Fiore, III ..... A47D 9/005 5/655
2016/0000232 A1 * 1/2016 Horst ..... A47D 5/00 5/655

FOREIGN PATENT DOCUMENTS

CN 201061386 Y 5/2008
CN 101361627 A 2/2009
CN 201370338 Y 12/2009
CN 201664118 U 12/2010
CN 202277090 U 6/2012
CN 102631103 A 8/2012
DE 202008017117 U1 5/2009
DE 102012002919 A1 8/2012
WO 8402260 A1 6/1984

* cited by examiner

INFANT CARE APPARATUS

CROSS-REFERENCE TO RELATED APPLICATION(S)

This application claims priority to U.S. Provisional Patent Application No. 61/998,593 filed on Jul. 2, 2014, the disclosure of which is incorporated herein by reference.

BACKGROUND

1. Field of the Invention

The present invention relates to reversible infant care apparatuses.

2. Description of the Related Art

Currently, baby changer products typically include stationary changing tables, and play yards with a top mounted changer station. The stationary changing tables usually have a great storage in the form of shelves and/or drawers. However, owing to large and bulky dimensions, the stationary changing tables offer limited options for placement in a room.

Removable diaper changing stations may be purchased with a play yard as an add-on device. The primary use of the play yard is to provide an environment for sleeping a child, and the diaper changing station mounted on the top rail of the play yard is an added secondary device that has no convenient storage capabilities. In addition, like the stationary changing table, the play yard usually has no height adjustment and is large in dimensions, which may limit its placement amongst existing furniture.

Therefore, there is a need for an improved design that can be flexible and safe in use, and can address at least the foregoing issues.

SUMMARY

The present application describes an infant care apparatus. In one embodiment, the infant care apparatus includes a support frame, an infant resting support, and a first and a second latch. The infant resting support has a first and a second bearing surface oriented in different directions, the infant resting support being rotationally connected with the support frame, and each of the first and second bearing surface being positionable to face upward for receiving a child thereon, wherein the infant resting support has a first position, a second position, and an angular position between the first and second positions, the first bearing surface facing upward when the infant resting support is in the first position, and the second bearing surface facing upward when the infant resting support is in the second position. The first latch is operable to rotationally lock the infant resting support with respect to the support frame in the first and second positions. The second latch is switchable from a disengaged state to an engaged state to stop the infant resting support in the intermediate angular position.

In other embodiments, the infant care apparatus includes a support frame, an infant resting support having a hub casing that is rotationally connected with the support frame, and a latch assembled with the support frame. The infant resting support has a first and a second bearing surface oriented in different directions, each of the first and second bearing surface being positionable to face upward for receiving a child thereon. The latch is slidable to engage and disengage the hub casing, the latch when engaged with the hub casing rotationally locking the infant resting support with respect to the support frame in any of a first and a second position, the first bearing surface facing upward when the infant resting support is in the first position, and the second bearing surface facing upward when the infant resting support is in the second position.

DETAILED DESCRIPTION OF THE EMBODIMENTS

Figure 1:
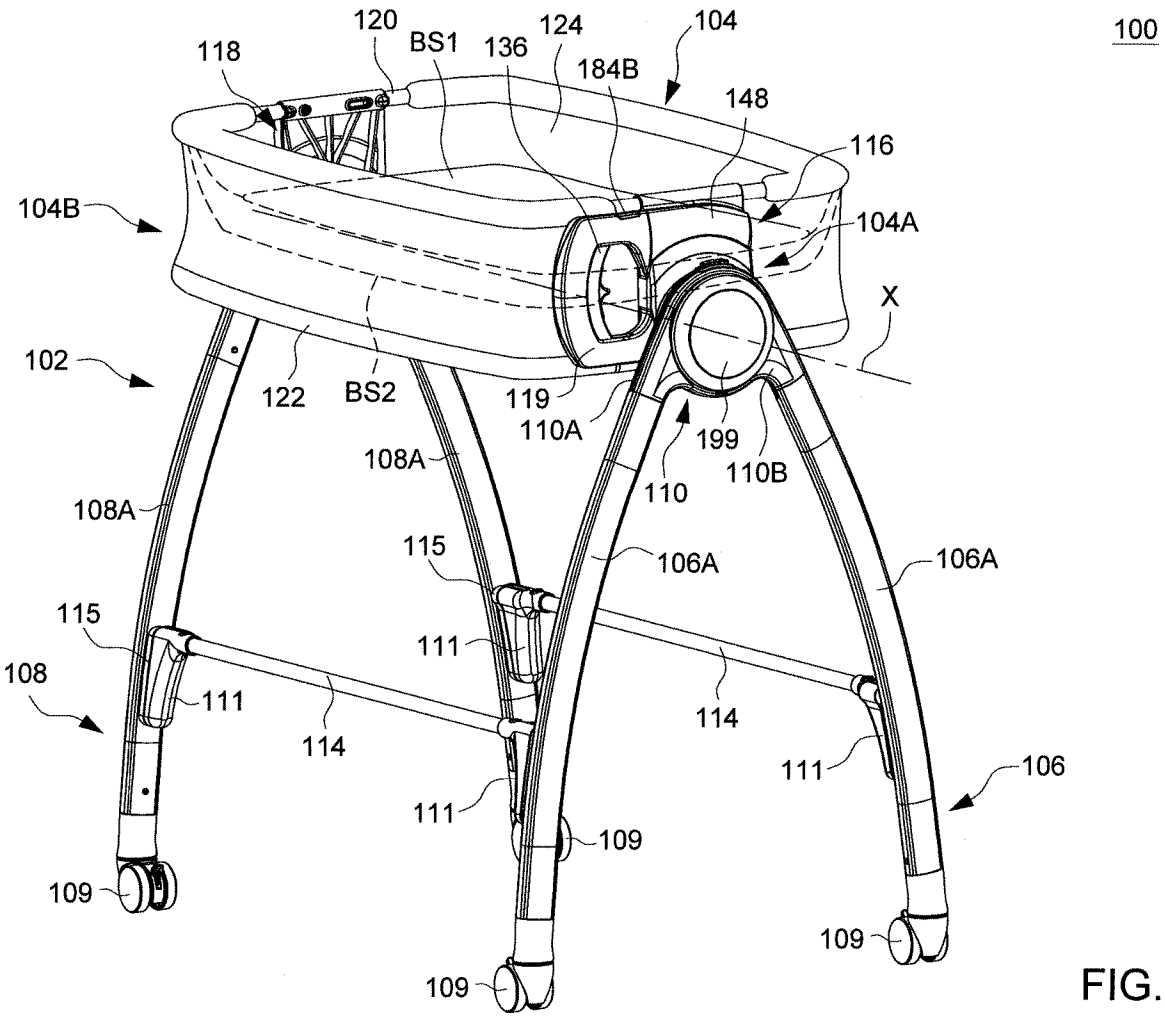
FIG. 1 is a schematic view illustrating an embodiment of an infant care apparatus.
Figure 2:
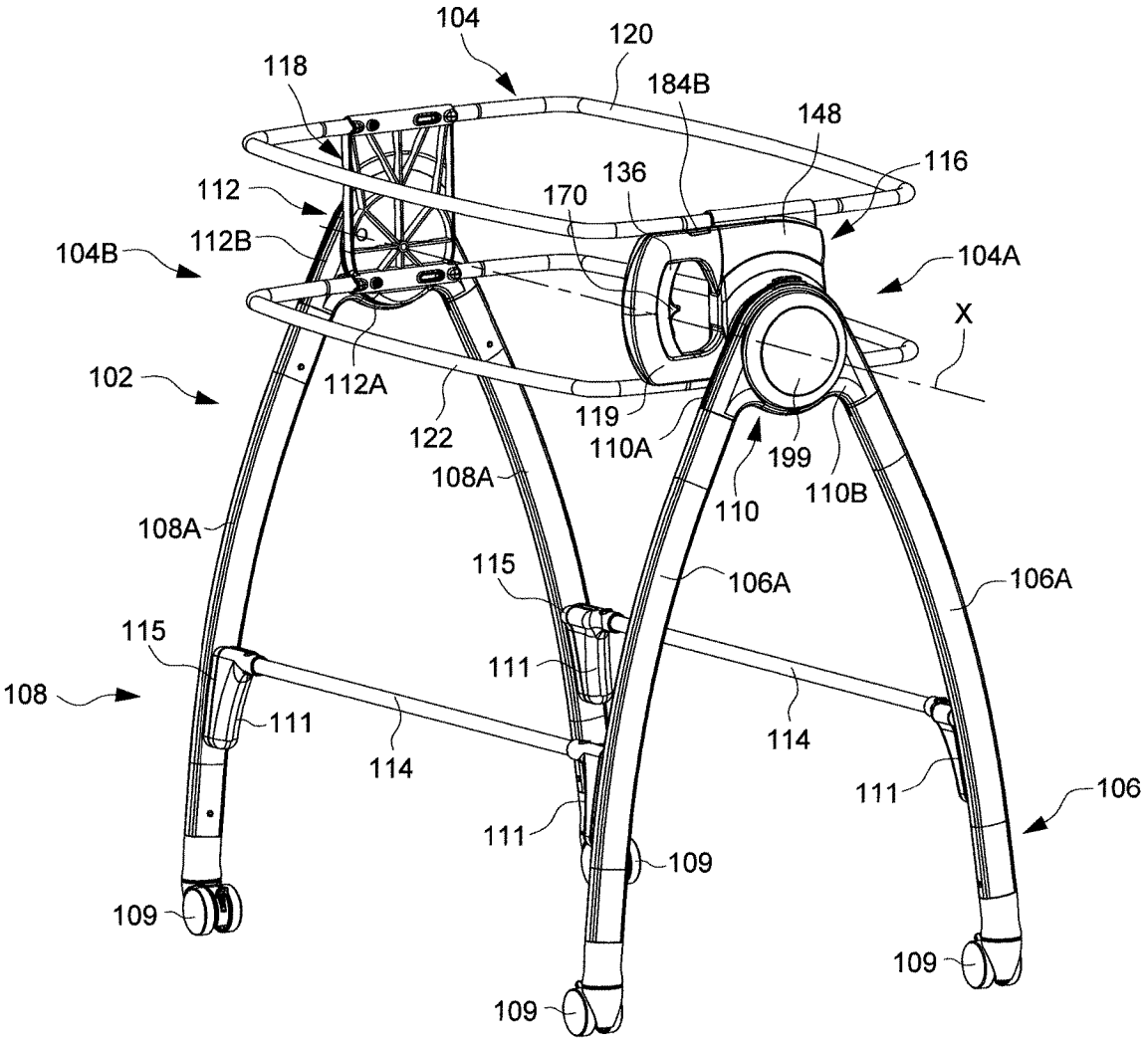
FIG. 2 is a schematic view illustrating a rigid frame structure of the infant care apparatus shown in FIG. 1 including a support frame and an infant resting support.
Figure 3:
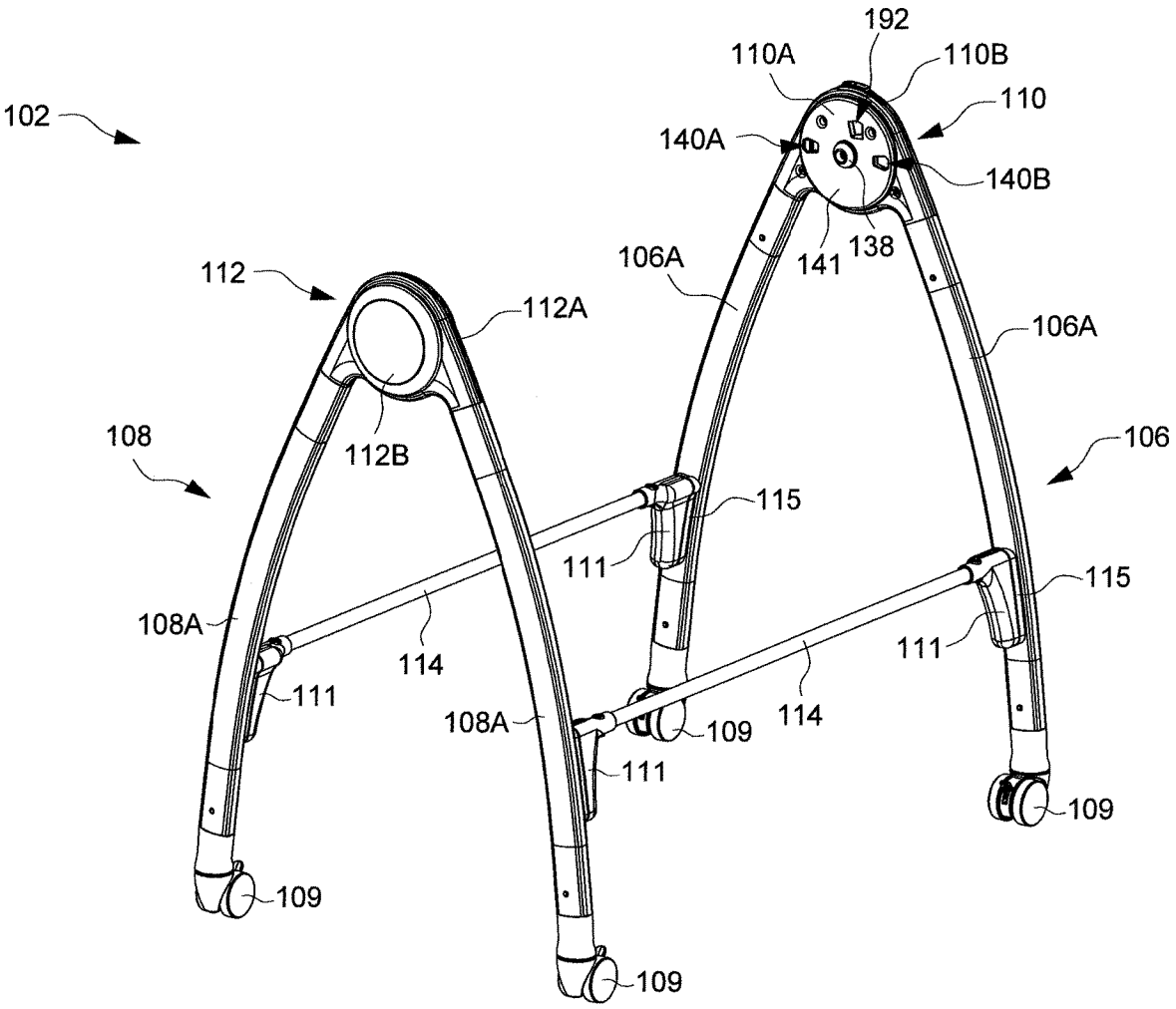
FIG. 3 is a schematic view illustrating the support frame of the infant care apparatus shown in FIG. 2.
Figure 4:
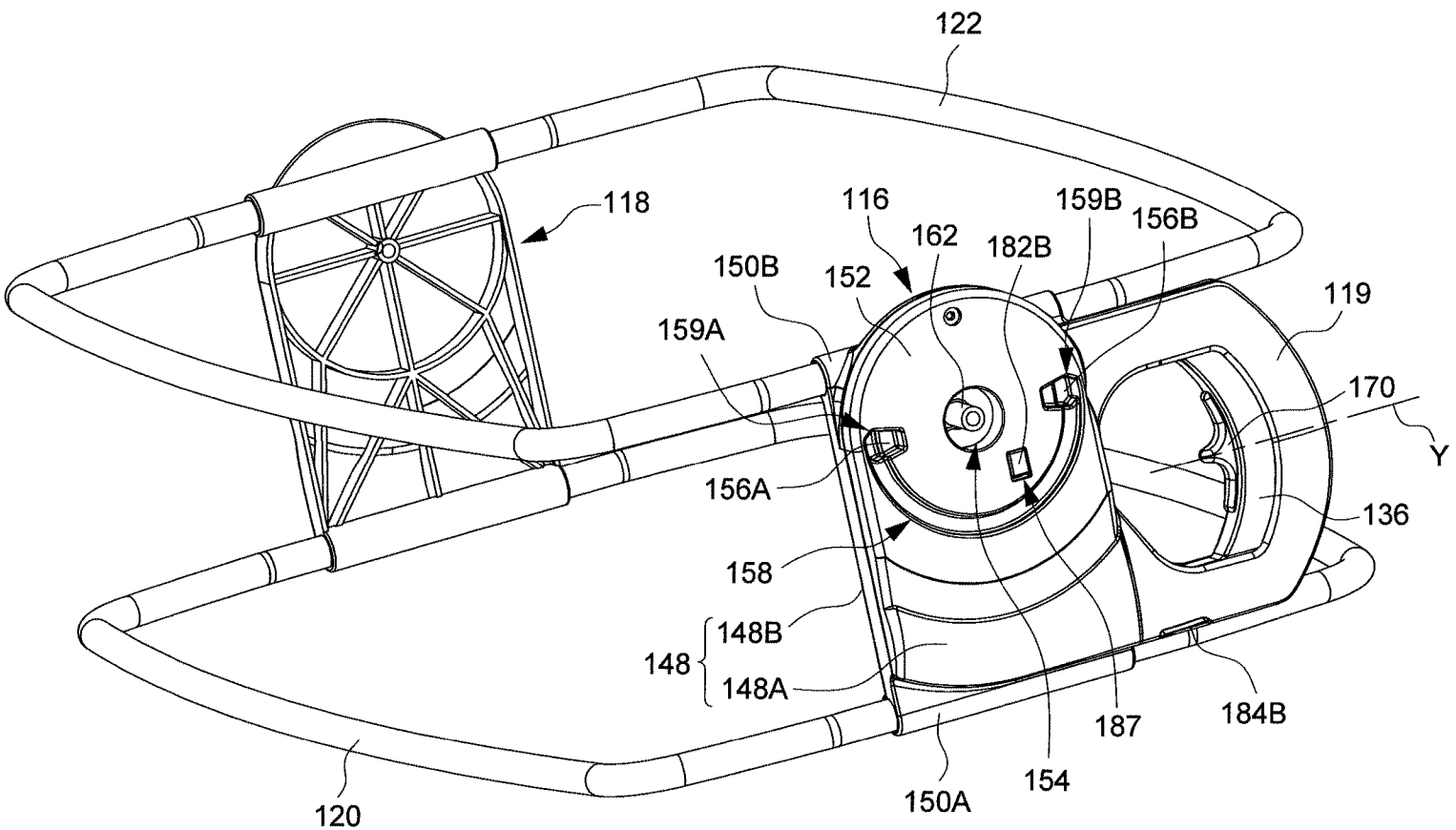
FIG. 4 is a schematic view illustrating a rigid frame structure of the infant resting support shown in FIG. 2

FIG. 1 is a perspective view illustrating one embodiment of an infant care apparatus 100, and FIG. 2 is a side view illustrating a rigid frame structure of the infant care apparatus 100 omitting a cloth and fabric envelope. The infant care apparatus 100 can include a support frame 102, and an infant resting support 104 rotationally connected with the support frame 102. The support frame 102 alone is further shown in FIG. 3, and a rigid frame structure of the infant resting support 104 is shown in FIG. 4. The support frame 102 can include two leg frames 106 and 108 disposed spaced apart from each other, and the infant resting support 104 can be disposed between the two leg frames 106 and 108. The leg frames 106 and 108 can be exemplary formed from the assembly of one or multiple tubes, and can have lower ends provided with wheel assemblies 109. With the wheel assemblies 109 rolling on a floor surface, the infant care apparatus 100 can easily move from one room to another room in a house.

The leg frame 106 can have two legs 106A that are connected with each other at an upper end portion of the leg frame 106. In one embodiment, the two legs 106A can be securely connected with each other via a joint structure 110 at the upper end portion of the leg frame 106. The joint structure 110 can exemplary include two housing portions 110A and 110B that are affixed with each other and are fastened to upper ends of the legs 106A.

The leg frame 108 can be disposed symmetrical and parallel to the leg frame 106, and can likewise have two legs 108A that are connected with each other at an upper end portion of the leg frame 108. The two legs 108A can be connected with each other via a joint structure 112 at the upper end portion of the leg frame 108. The joint structure 112 can likewise exemplary include two housing portions 112A and 112B that are affixed with each other, and are fastened to upper ends of the legs 108A.

Support bars 114 can be respectively affixed between the legs 106A and 108A below the infant resting support 104 to as to provide support for a storage basket (not shown). In one embodiment, the support bars 114 may be attached with the legs 106A and 108A via a snapping system that allows quick assembly. Referring to FIGS. 1-3 and 15, each of the support bars 114 can have two opposite ends affixed with an end connector 111 having two spaced-apart studs 113, and each of the legs 106A and 108A can be affixed with a mount socket 115 having two spaced-apart apertures 117 respectively associated with the studs 113. Each stud 113 can have an enlarged head portion 113A connected with a narrow neck portion 113B, and each aperture 117 can have an enlarged opening portion 117A and a narrow opening portion 117B connected with each other. For assembling one support bar 114 with two legs 106A and 108A, the head portion 113A of the stud 113 is first inserted into the enlarged opening portion 117A of the corresponding aperture 117, and the support bar 114 and end connector 111 are then displaced downward to cause the neck portion 113B to engage with the narrow opening portion 117B. Since the head portion 113A is larger than the narrow opening portion 117B, the end connector 111 cannot be detached from the mount socket 115 while the neck portion 113B remains engaged with the narrow opening portion 117B. While the snapping system has been described as having two studs 113 engaged with two apertures 117, it will be understood that each support bar 114 may also be affixed with each of the legs 106A and 108A by providing one stud 113 on the end connector 111 which engages with one aperture 117 provided on the mount socket 115.

Referring again to FIGS. 1-3, a first side 104A of the infant resting support 104 can be rotationally connected with the leg frame 106 adjacent to an inner surface of the joint structure 110, and a second side 104B of the infant resting support 104 opposite to its first side 104A can be rotationally connected with the leg frame 108 adjacent to an inner surface of the joint structure 112. More specifically, the first and second sides 104A and 104B of the infant resting support 104 can be respectively affixed with rotary hubs 116 and 118. The two rotary hubs 116 and 118 can be respectively connected pivotally with the two leg frames 106 and 108 about a pivot axis X that extends along a lengthwise axis of the infant resting support 104. Through the aforementioned assembly, the infant resting support 104 and the rotary hubs 116 and 118 affixed therewith can rotate about the pivot axis X relative to the support frame 102. For facilitating adjustment of the infant resting support 104, the rotary hub 116 can further have a grip portion 119 that is easy to grasp. A caregiver thus can directly grasp the grip portion 119 with one hand, and then rotationally adjust the infant resting support 104 as desired.

Referring to FIGS. 1, 2 and 4, the infant resting support 104 can include two rigid frame portions 120 and 122 arranged parallel and offset with respect to each other. Each of the frame portions 120 and 122 can have a similar closed shape formed by the assembly of one or more tubular segments. A cloth material 124 can be wrapped around the frame portions 120 and 122 so as to define an outer envelope of the infant resting support 104, which can be provided with two opposite bearing surfaces BS1 and BS2 respectively adapted to receive the placement of a child. The first and second bearing surfaces BS1 and BS2 are oriented in different directions, and can be configured to provide different functions. For example, when it is turned upward, the first bearing surface BS1 can be configured as a changer table having a relative flat and stiff bearing surface for supporting a child. In contrast, the second bearing surface BS2 when facing upward can be configured as a bed or bassinet having a curved, softer bearing surface to provide comfortable sleeping support for a child.

Figure 5:
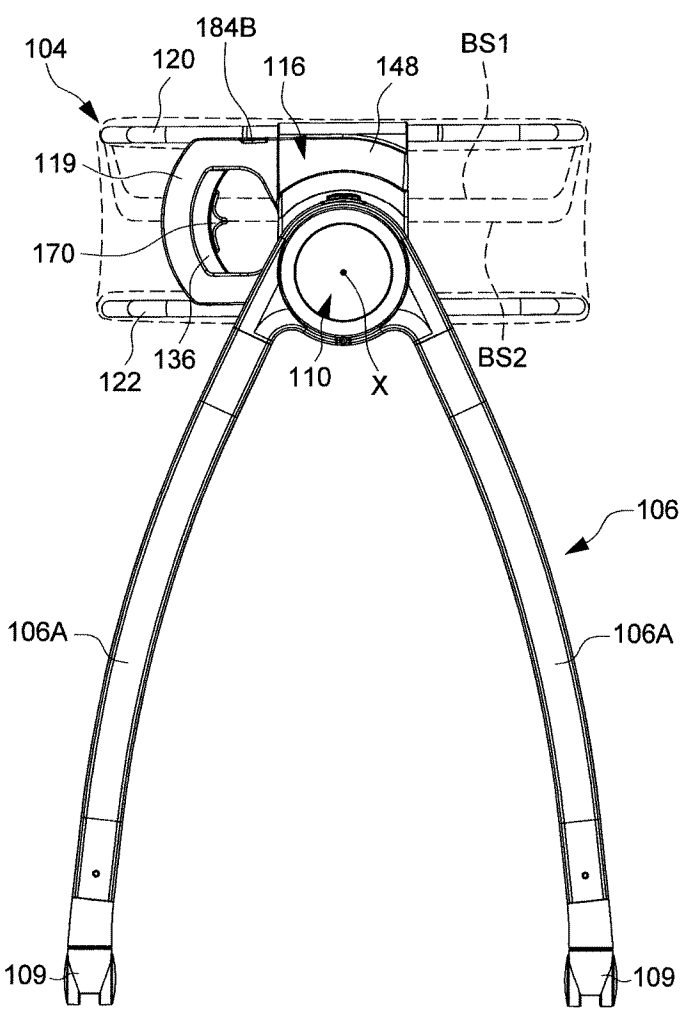
FIG. 5 is a schematic view illustrating the infant care apparatus with the infant resting support placed in a first position corresponding to a first configuration of use.
Figure 6:
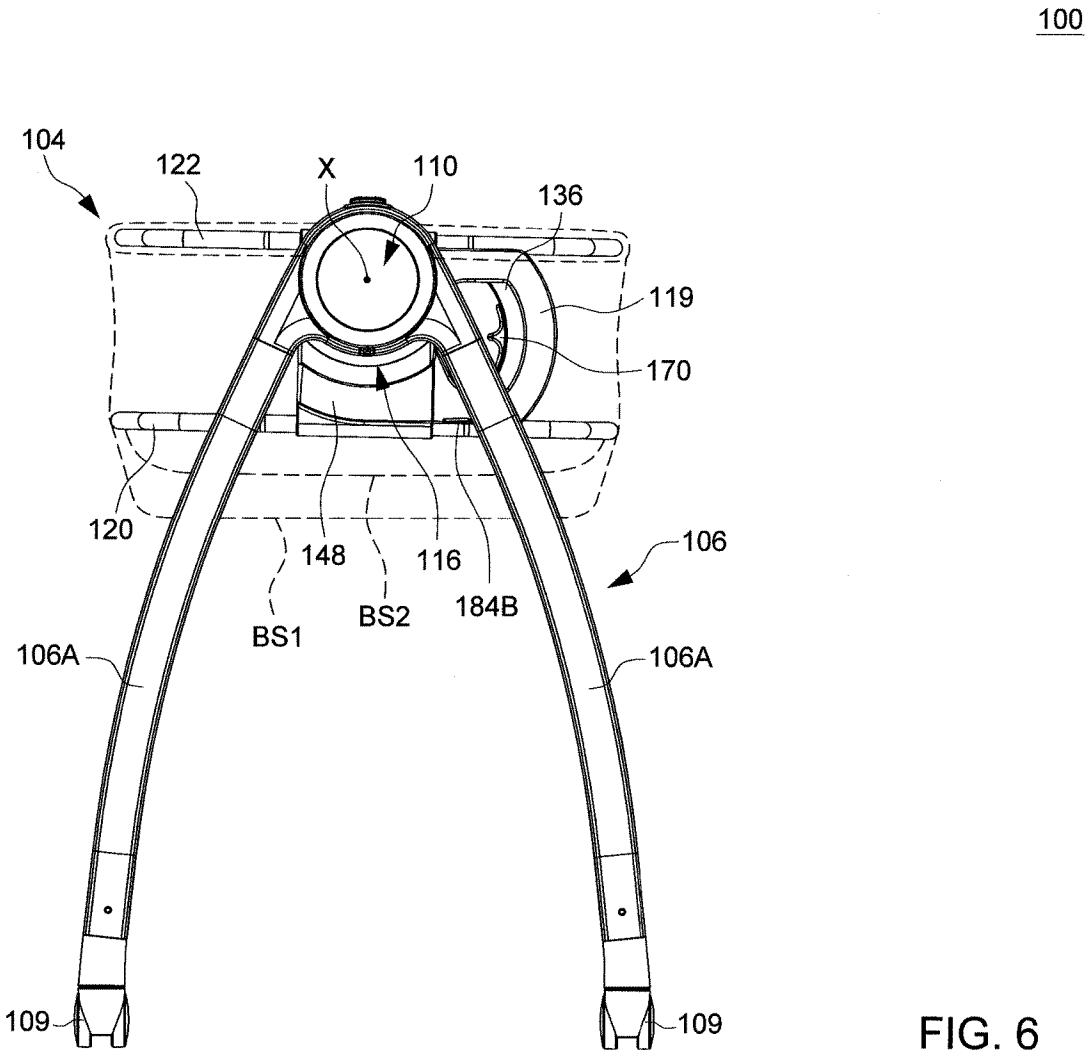
FIG. 6 is a schematic view illustrating the infant care apparatus with the infant resting support rotated to a second position corresponding to a second configuration of use.

The aforementioned frame connection allows the infant resting support 104 to rotate about the pivot axis X relative to the support frame 102 so that either of the first and second bearing surface BS1 and BS2 can be positioned to face upward for receiving a child thereon. FIG. 5 is a schematic view illustrating the infant resting support 104 in a first position corresponding to a first configuration of use where the second bearing surface BS2 faces downward and the first bearing surface BS1 faces upward for receiving a child thereon, and FIG. 6 is a schematic view illustrating the infant resting support 104 in a second position corresponding to a second configuration of use with where the first bearing surface BS1 faces downward and the second bearing surface BS2 faces upward for receiving a child thereon. A depth of the first bearing surface BS1 with respect to a top of the infant resting support 104 in the first configuration shown in FIG. 5 is smaller than a depth of the second bearing surface BS2 with respect to a top of the infant resting support 104 in the second configuration shown in FIG. 6. Moreover, the first bearing surface BS1 facing upward can be located above the pivot axis X when the infant resting support 104 is in the first position, and the second bearing surface BS2 facing upward is located below the pivot axis X when the infant resting support 104 is in the second position. This can facilitate the use of the infant resting support 104 as a changer when the first bearing surface BS1 faces upward, and as a bassinet when the second bearing surface BS2 faces upward.

In conjunction with FIGS. 1-6, reference is further made to FIGS. 7-12 to describe a latch mechanism 130 for rotationally locking the infant resting support 104 with respect to the support frame 102 in any of the first and second positions shown in FIGS. 5 and 6. Referring to FIGS. 7-12, the latch mechanism 130 is provided at the side where the rotary hub 116 pivotally connects with the leg frame 106. The latch mechanism 130 can include a latch 132, a spring 134 and a release member 136. The latch 132 and the spring 134 can be assembled with the joint structure 110, and the release member 136 can be assembled with the rotary hub 116.

Figure 7:
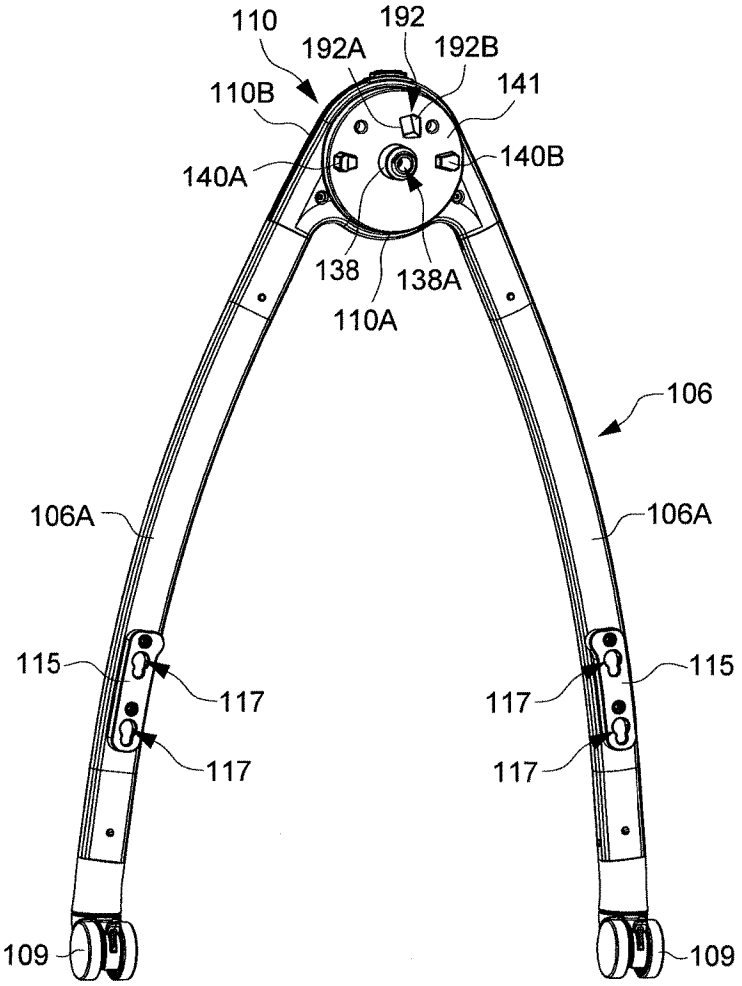
FIG. 7 is a schematic view illustrating a leg frame of the support frame where is assembled a latch mechanism operable to lock the infant resting support in any of the first and second positions shown in FIGS. 5 and 6.
Figure 8:
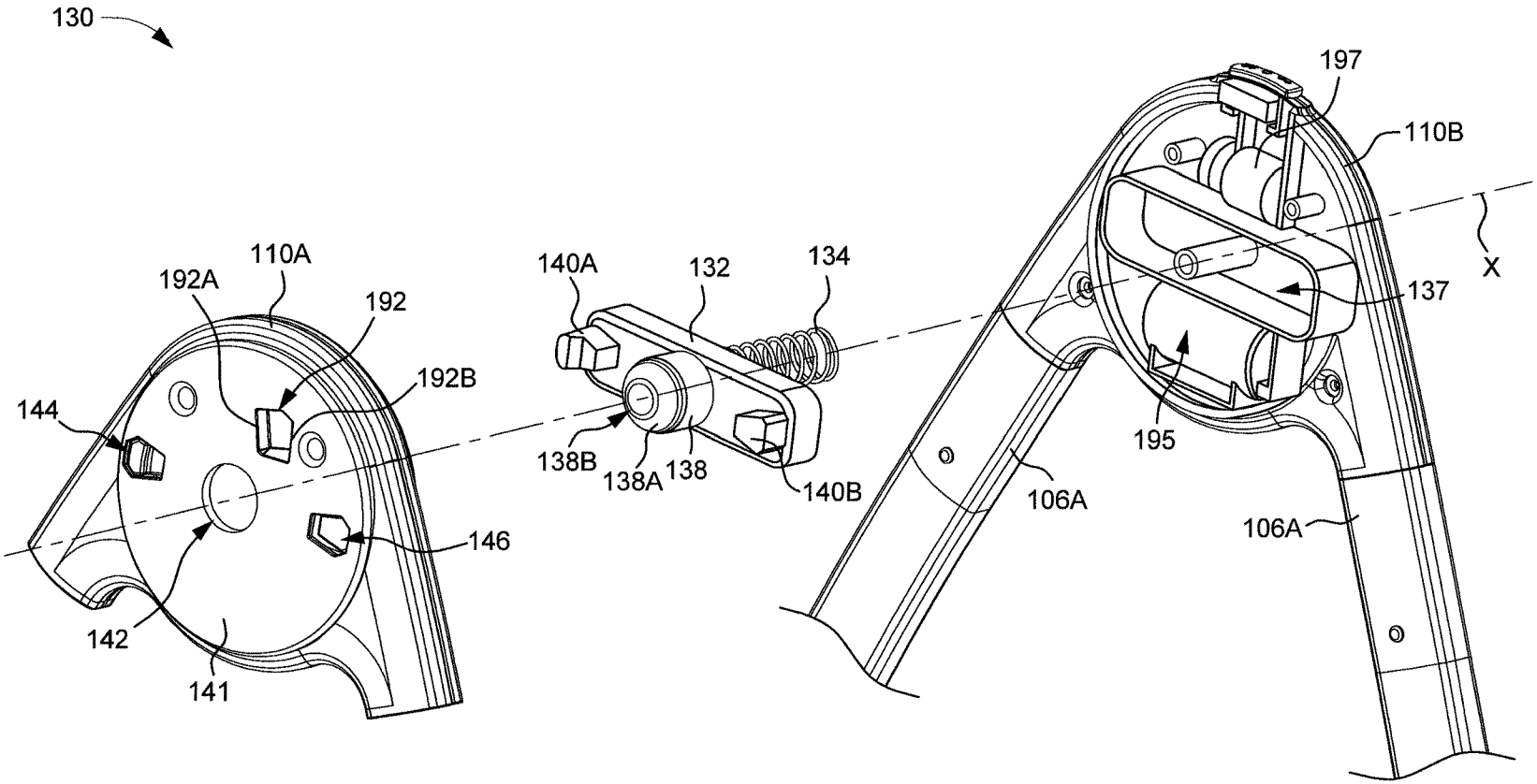
FIG. 8 is an exploded view illustrating a joint structure of the leg frame shown in FIG. 7 including a portion of the latch mechanism.
Figure 9:
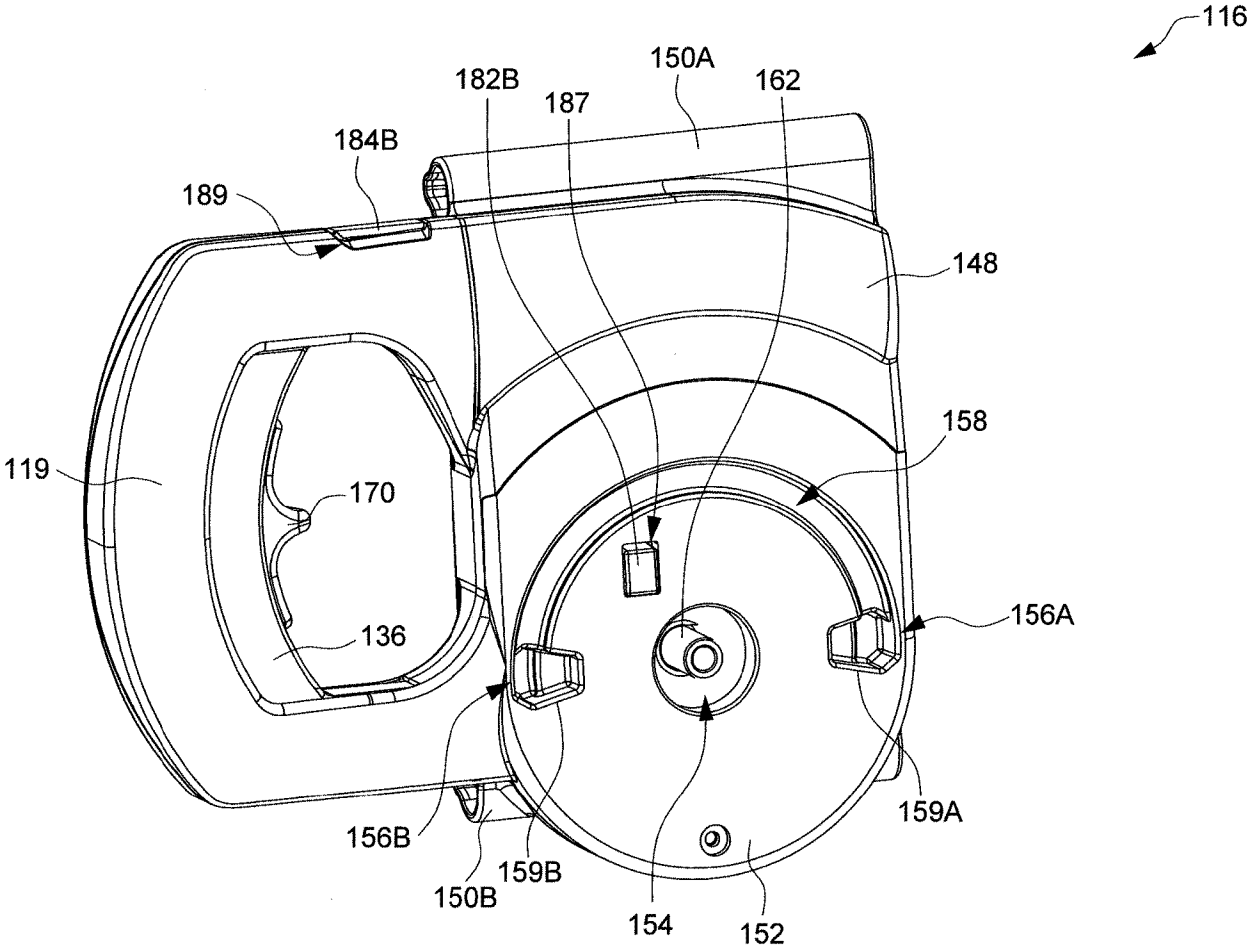
FIG. 9 is a schematic view illustrating a rotary hub of the infant resting support where is connected with the joint structure shown in FIG. 8.

FIG. 7 is a schematic view illustrating the leg frame 106 alone, and FIG. 8 is an exploded view illustrating a construction of the joint structure 110. Referring to FIGS. 7 and 8, the housing portions 110A and 110B of the joint structure 110 can define an inner cavity in which the latch 132 can be assembled for sliding movement along the pivot axis X. For example, a channel 137 can be provided in the inner cavity of the joint structure 110, and the latch 132 can be slidably assembled in the channel 137. The latch 132 can be provided as a unitary part having a protruding knob 138 and two studs 140A and 140B protruding at a same side of the latch 132. The knob 138 can be placed in a position centered about the pivot axis X of the infant resting support 104, and a distal end of the knob 138 can have a tapered portion 138A. The two studs 140A and 140B can be arranged at diametrically opposite positions relative to the pivot axis X of the infant resting support 104, and the stud 140A can protrude higher than the stud 140B. The housing portion 110A of the joint structure 110 can have a surface 141 formed with a plurality of holes 142, 144 and 146, and the knob 138 and the two studs 140A and 140B of the latch 132 can respectively project outside the joint structure 110 through the holes 142, 144 and 146 toward the rotary hub 116 of the infant resting support 104.

The spring 134 can be connected with the latch 132 and an inner sidewall of the housing portion 110B. The spring 134 can bias the latch 132 to slide along the pivot axis X to a locking state for engaging with the rotary hub 116.

Referring to FIGS. 2, 4 and 9-11, the rotary hub 116 can include a hub casing 148 that is fixedly attached to the two frame portions 120 and 122 and is pivotally connected with the joint structure 110 about the pivot axis X. The hub casing 148 can have two sleeve portions 150A and 150B through which the frame portions 120 and 122 are respectively affixed, and the grip portion 119 can be affixed with the hub casing 148 between the two frame portions 120 and 122. In one embodiment, the hub casing 148 can be formed by the assembly of two casing portions 148A and 148B, the casing portion 148A having a surface 152 facing the joint structure 110. The surface 152 of the casing portion 148A can have a hole 154 centered about the pivot axis X of the infant resting support 104, and two openings 156A and 156B diametrically opposite to each other relative to the pivot axis X. The position of the hole 154 is aligned with the position of the knob 138 of the latch 132. The surface 152 of the casing portion 148A can further have a guide track 158 that is connected with the two openings 156A and 156B. The guide track 158 can have an arc shape substantially centered about the pivot axis X. Moreover, the surface 152 of the hub casing 148 can include two opposite limiting sidewalls 159A and 159B respectively arranged adjacent to the two openings 156A and 156B.

The latch 132 can slide along the pivot axis X to engage and disengage the hub casing 148. More specifically, the studs 140A and 140B of the latch 132 can protrude outside the joint structure 110 and respectively engage with the openings 156A and 156B of the hub casing 148 to rotationally lock the infant resting support 104 in the first position shown in FIG. 5, and the studs 140A and 140B of the latch 132 can respectively engage with the openings 156B and 156A to rotationally lock the infant resting support 104 in the second position shown in FIG. 6. Because the height of the stud 140A is greater than that of the stud 140B, the stud 140A after being disengaged from the openings 156A or 156B can remain in the guide track 158 and be guided for moving along the guide track 158 during rotation of the infant resting support 104 between the first and second positions. The stud 140A thus is limited to move along the guide track 158 between the two limiting sidewalls 159A and 159B, which can limit the infant resting support 104 to rotate within an angular range of about 180 degrees.

Referring to FIGS. 8-11, the casing portions 148A and 148B can define an inner cavity through which the release member 136 is arranged. The release member 136 can be formed as a handle, and is at least partially exposed outside the hub casing 148 for manual operation by a caregiver. As shown, the release member 136 can be arranged between the two frame portions 120 and 122 and adjacent to the grip portion 119 so that a caregiver can conveniently grasp the grip portion 119 and operate the release member 136 with a same hand. The release member 136 can be formed as one unitary part having a recessed portion 160 that is arranged adjacent to the pivot axis X and is at least partially exposed through the hole 154 of the casing portion 148A. The recessed portion 160 has a ramp surface 160A, and is positioned adjacent to the knob 138 of the latch 132. In one embodiment, the ramp surface 160A is at least partially conical in shape. The recessed portion 160 can further include a hole 161, and the casing portion 148B of the hub casing 148 can be affixed with a shaft portion 162 that passes through the hole 161. More specifically, the shaft portion 162 can be aligned with the pivot axis X, and respectively pass through the hole 161 and a hole 138B (better shown in FIG. 8) formed through the knob 138 to achieve the pivotal connection between the rotary hub 116 and the joint structure 110. The shaft portion 162 can also provide sliding support for the latch 132.

The release member 136 is assembled with the hub casing 148 for sliding in a plane that is substantially perpendicular to the pivot axis X of the infant resting support 104 and generally parallel to the leg frame 106. More specifically, the release member 136 can slide in two opposite directions along an displacement axis Y in the plane substantially perpendicular to the pivot axis X. The displacement axis Y can be substantially horizontal when the infant resting support 104 is in any of the first and second positions shown in FIGS. 5 and 6. The release member 136 can be independently operable to slide along the displacement axis Y between two positions: an active position corresponding to the unlocking state of the latch 132, and a de-active position corresponding to the locking state of the latch 132. More specifically, a displacement of the release member 136 to the active position causes the ramp surface 160A of the recessed portion 160 to push against the knob 138 so that the latch 132 is urged to move from the locking state to the unlocking state for compressing the spring 134 and disengaging the studs 140A and 140B of the latch 132 from the hub casing 148. Reversely, a displacement of the release member 136 to the de-active position releases the pushing action of the ramp surface 160A on the knob 138, whereby the latch 132 can be urged by the spring 134 to move from the unlocking state to the locking state.

A spring 171 can be arranged in the hub casing 148, and can have two opposite ends respectively connected with a post 164 affixed with the release member 136 and an inner sidewall 165 of the hub casing 148. The spring 171 can bias the release member 136 to the de-active position for facilitating displacement of the latch 132 to the locking state.

When a caregiver wants to adjust the infant resting support 104 between the two configurations of use shown in FIGS. 5 and 6, the release member 136 can be manually pulled to slide along the displacement axis Y, which causes the ramp surface 160A of the release member 136 to push against the knob 138 of the latch 132 and thereby urge the latch 132 to move from the locking state to the unlocking state for compressing the spring 134 and disengaging the studs 140A and 140B of the latch 132 from the hub casing 148 of the infant resting support 104. The unlocked infant resting support 104 then can rotate relative to the support frame 102 and the latch 132 until it reaches the desired configuration corresponding to the first or second position shown in FIGS. 5 and 6. Once the infant resting support 104 is in the desired position, the release member 136 can be released, and the spring 171 biases the release member 136 to recover its initial de-active position. Moreover, the latch 132 can switch to the locking state engaged with the hub casing 148 of the infant resting support 104. The studs 140A and 140B of the latch 132 can respectively engage with the openings 156A and 156B of the hub casing 148 to rotationally lock the infant resting support 104 in the first position shown in FIG. 5, and the studs 140A and 140B of the latch 132 can respectively engage with the openings 156B and 156A to rotationally lock the infant resting support 104 in the second position shown in FIG. 6.

Figure 10:
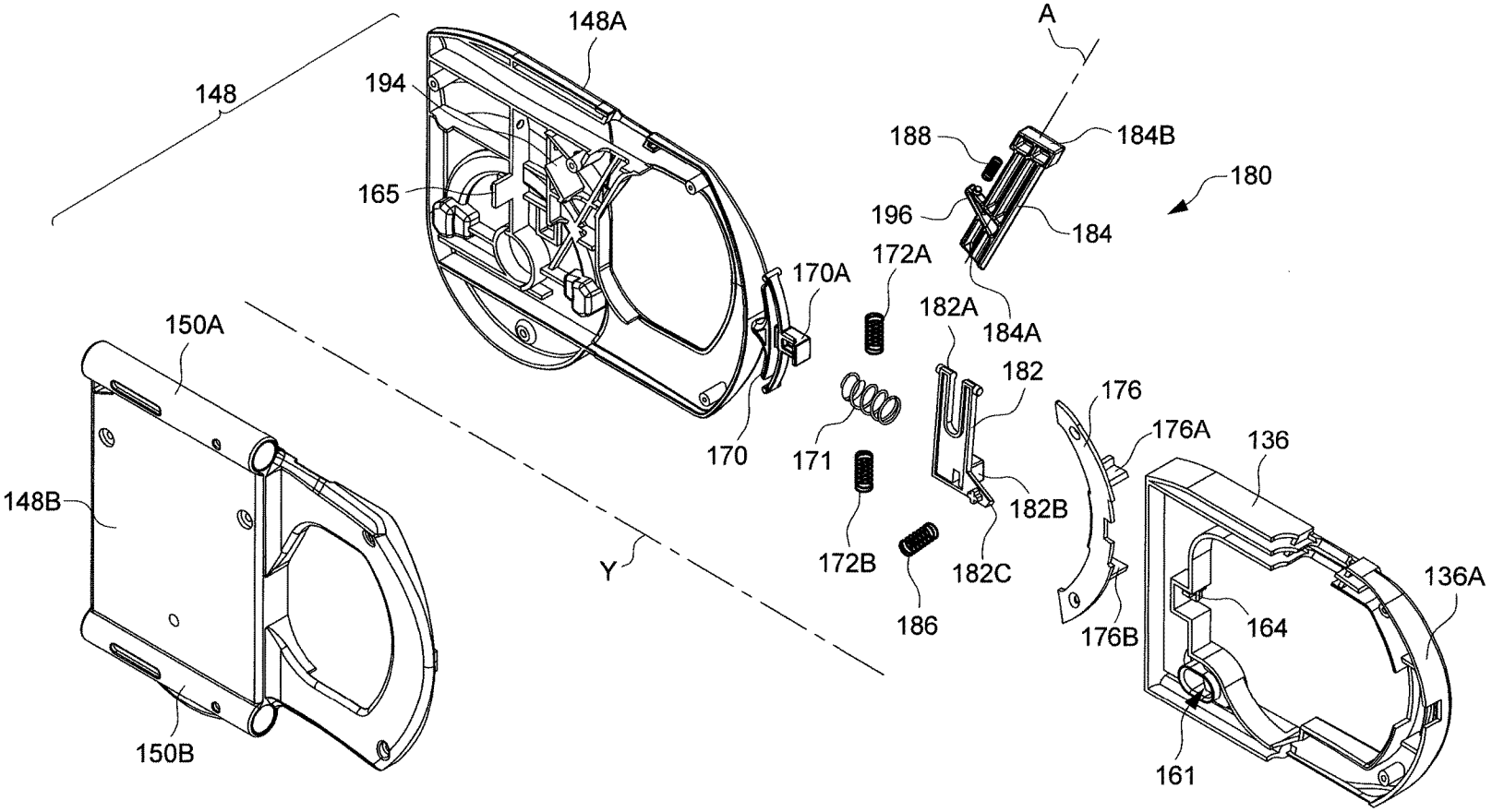
FIG. 10 is an exploded view illustrating the rotary hub shown in FIG. 9.
Figure 11:
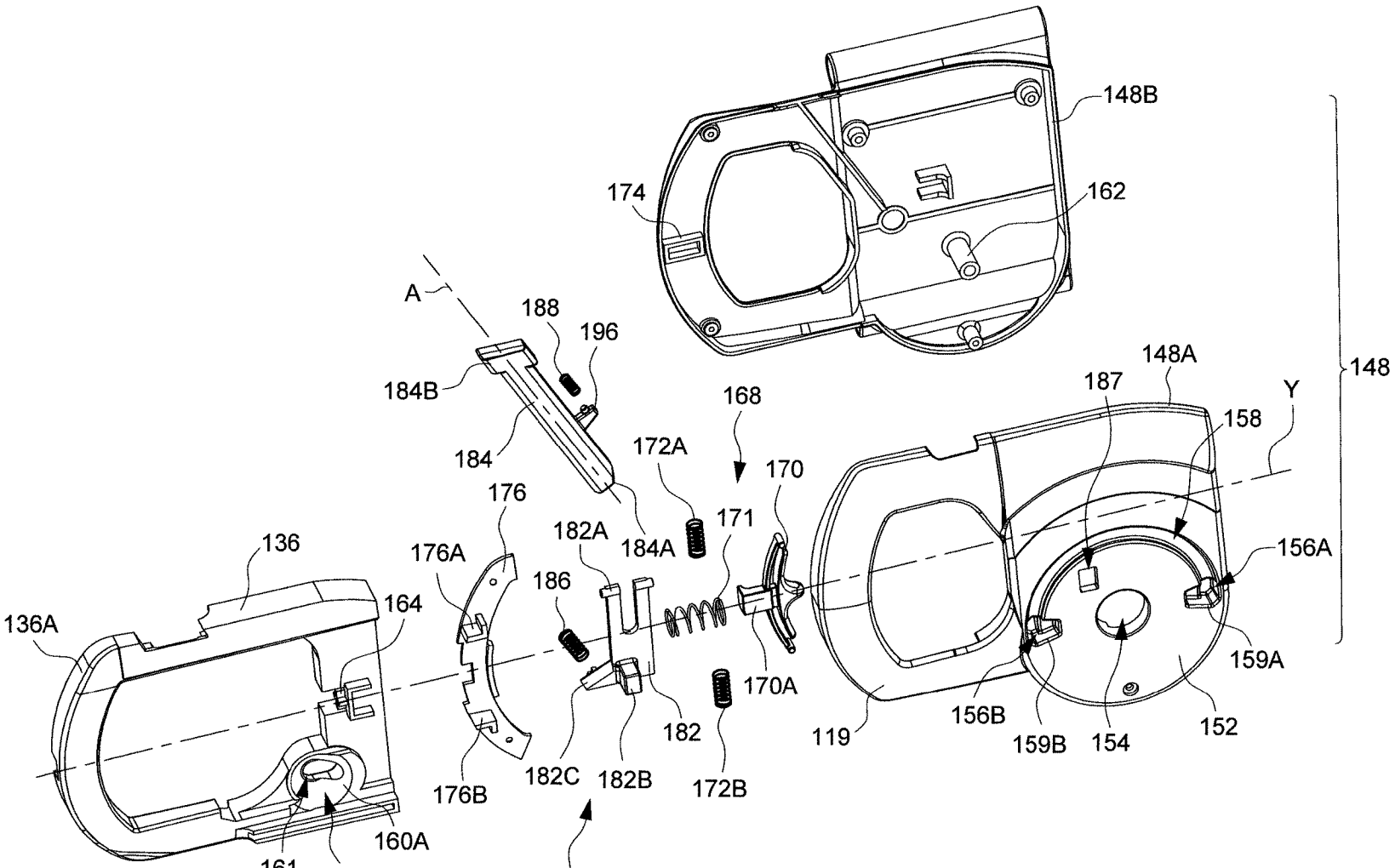
FIG. 11 is an exploded view illustrating the rotary hub under an opposite angle of view.
Figure 12:
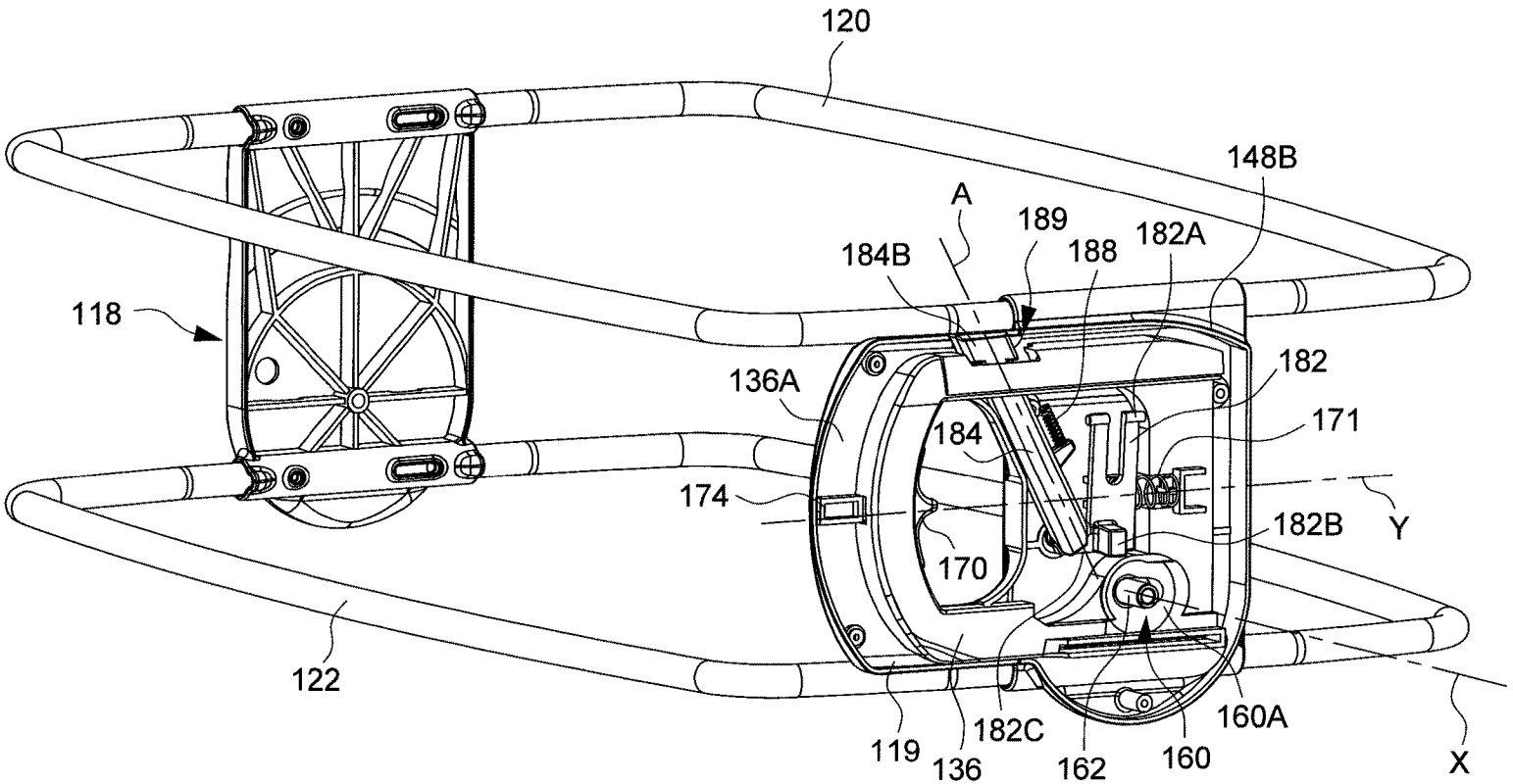
FIG. 12 is a schematic view illustrating an interior of the rotary hub assembled with the infant resting support.

Referring to FIGS. 10-12, a safety lock mechanism 168 may be further provided to prevent accidental operation of the release member 136. The safety lock mechanism 168 can include an impeding part 170, two springs 172A and 172B, and a rib 174 affixed with the hub casing 148 (e.g., with the casing portion 148B of the hub casing 148). The impeding part 170 is assembled with the release member 136, and can move with the release member 136 along the displacement axis Y. Moreover, the impeding part 170 can be operable to slide relative to the release member 136 in two opposite directions along an axis that extends transversally relative to the displacement axis Y of the release member 136. The axis along which the impeding part 170 is movable extends generally up and down when the infant resting support 104 is in any of the two positions shown in FIGS. 5 and 6.

The two springs 172A and 172B are arranged so as to bias the impeding part 170 in two opposite directions. In one embodiment, the impeding part 170 may include a protrusion 170A, and the two springs 172A and 172B may be assembled at two opposite sides of the protrusion 170A. For facilitating the assembly of the springs 172A and 172B, a bracket 176 having two spaced-apart lips 176A and 176B may be affixed with the hub casing 148. The spring 172A can have two opposite ends respectively connected with the lip 176A of the bracket 176 and the protrusion 170A of the impeding part 170, and the spring 172B can have two opposite ends respectively connected with the lip 176B of the bracket 176 and the protrusion 170A of the impeding part 170.

In the safety lock mechanism 168, the two springs 172A and 172B are operable to bias the impeding part 170 to a blocking position where the impeding part 170 can abut against the rib 174 to block sliding of the release member 136 in the direction for switching the latch 132 from the locking state to the unlocking state. For unlocking the safety lock mechanism 168, the impeding part 170 can be manually operated to slide in either direction away from the blocking position to disengage the protrusion 170A from the rib 174. Once the impeding part 170 is disengaged, the release member 136 can be operated as described previously to switch the latch 132 from the locking state to the unlocking state. The impeding part 170 can travel past the rib 174 as the release member 136 slides for switching the latch 132 to the unlocking state.

Referring again to FIGS. 10-12, the infant care apparatus 100 described herein can further include a rotation safety lock 180 configured to limit a rotational displacement of the infant resting support 104 away from the first position shown in FIG. 5. Because the first bearing surface BS1 when facing upward (as shown in FIG. 5) is held at a shallower depth and above the pivot axis X, it may be possible that the infant resting support 104 having a child placed on the first bearing surface BS1 accidentally rotates about the pivot axis X, especially if the latch 132 is not properly engaged with the rotary hub 116. The rotation safety lock 180 described herein is a one way lock that can prevent accidental rotation of the infant resting support 104 from the first position shown in FIG. 5 to the second position shown in FIG. 6, but allow continuous rotation of the infant resting support 104 from the second position shown in FIG. 6 to the first position shown in FIG. 5.

Referring to FIGS. 10-12, the rotation safety lock 180 can include a latch 182, a release actuator 184 and two springs 186 and 188. These components of the rotation safety lock 180 can be compactly assembled in the hub casing 148 in proximity of the release member 136. The latch 182 is operable independently from the latch 132, and can to stop the infant resting support 104 in an intermediate angular position (better shown in FIG. 13) between the first position shown in FIG. 5 and the second position shown in FIG. 6. More specifically, the latch 182 is spring-biased to stop the infant resting support 104 in the intermediate angular position when the infant resting support 104 rotates in a first direction from the first position toward the second position, and allows rotation of the infant resting support 104 in a second direction from the second position past the intermediate angular position to the first position.

In one embodiment, the latch 182 can be formed as a unitary part having an elongated shape that is movably assembled with the hub casing 148. The latch 182 can include a mount portion 182A, and a protrusion 182B and a ramp surface 182C respectively spaced apart from the mount portion 182A. The latch 182 can be pivotally connected with the hub casing 148 at the mount portion 182A. The protrusion 182B can extend outside the hub casing 148 through an aperture 187 formed through the casing portion 148A of the hub casing 148, and can engage with an opening 192 provided on the joint structure 110 of the leg frame 106.

The opening 192 can be exemplary formed on the surface 141 of the housing portion 110A of the joint structure 110 in a region between the two studs 140A and 140B of the latch 132. More specifically, the opening 192 can be placed eccentric from the pivot axis X at a location corresponding to the aforementioned intermediate angular position.

The spring 186 can have two ends respectively connected with the hub casing 148 and the latch 182, and can apply a spring force on the latch 182 at a location offset from the mount portion 182A. The spring 186 can rotationally bias the latch 182 in a direction causing the protrusion 182B to project outward through the aperture 187 for engaging with the opening 192 on the joint structure 110 of the support frame 102.

Referring to FIGS. 10-12, the release actuator 184 can be disposed adjacent to the release member 136. The release actuator 184 can be provided as a unitary part having a distal end 184A and an operating portion 184B. The distal end 184A of the release actuator 184 can be in sliding contact with the ramp surface 182C of the latch 182, and the operating portion 184B can be exposed through an aperture 189 formed through the hub casing 148. The release actuator 184 can be assembled with the hub casing 148 for sliding movement along an axis A that is tilted an angle relative to the displacement axis Y of the release member 136. In particular, the release actuator 184 can move between an outwardly protruding state where the operating portion 184B projects outward from the aperture 189 of the hub casing 148, and a depressed state in which the operating portion 184B is retracted toward an interior of the aperture 189. The release actuator 184 remains in the depressed state relative to the hub casing 148 when the infant resting support 104 is at any positions other than the intermediate angular position, and is in the outwardly protruding state relative to the hub casing 148 when the infant resting support 104 is in the intermediate angular position.

The spring 188 can have two opposite ends respectively connected with the release actuator 184 and a fixed point of the hub casing 148. The spring 188 can bias the release actuator 184 inward to the depressed state, the biasing force of the spring 188 being smaller than that of the spring 186 connected with the latch 182 so as not to affect the latching function of the latch 182. To limit the inward displacement of the release actuator 184, the hub casing 148 can further have a sidewall 194 against which a rib 196 affixed with the release actuator 184 can contact once it reaches the depressed state.

Reference is made to FIGS. 5, 7-13 to describe exemplary operation of the rotation safety lock 180. In FIG. 5, the infant resting support 104 is shown in the first position with the first bearing surface BS1 facing upward. In this first configuration, the release actuator 184 is kept in the depressed state by the spring 188, and the latch 182 can be in a disengaged state with respect to the joint structure 110, i.e., the protrusion 182B of the latch 182 is not engaged with the opening 192 on the joint structure 110 of the support frame 102. While the latch 182 is in the disengaged state, the protrusion 182B of the latch 182 can contact with the housing portion 110A of the joint structure 110 owing to the biasing action applied by the spring 186.

Figure 13:
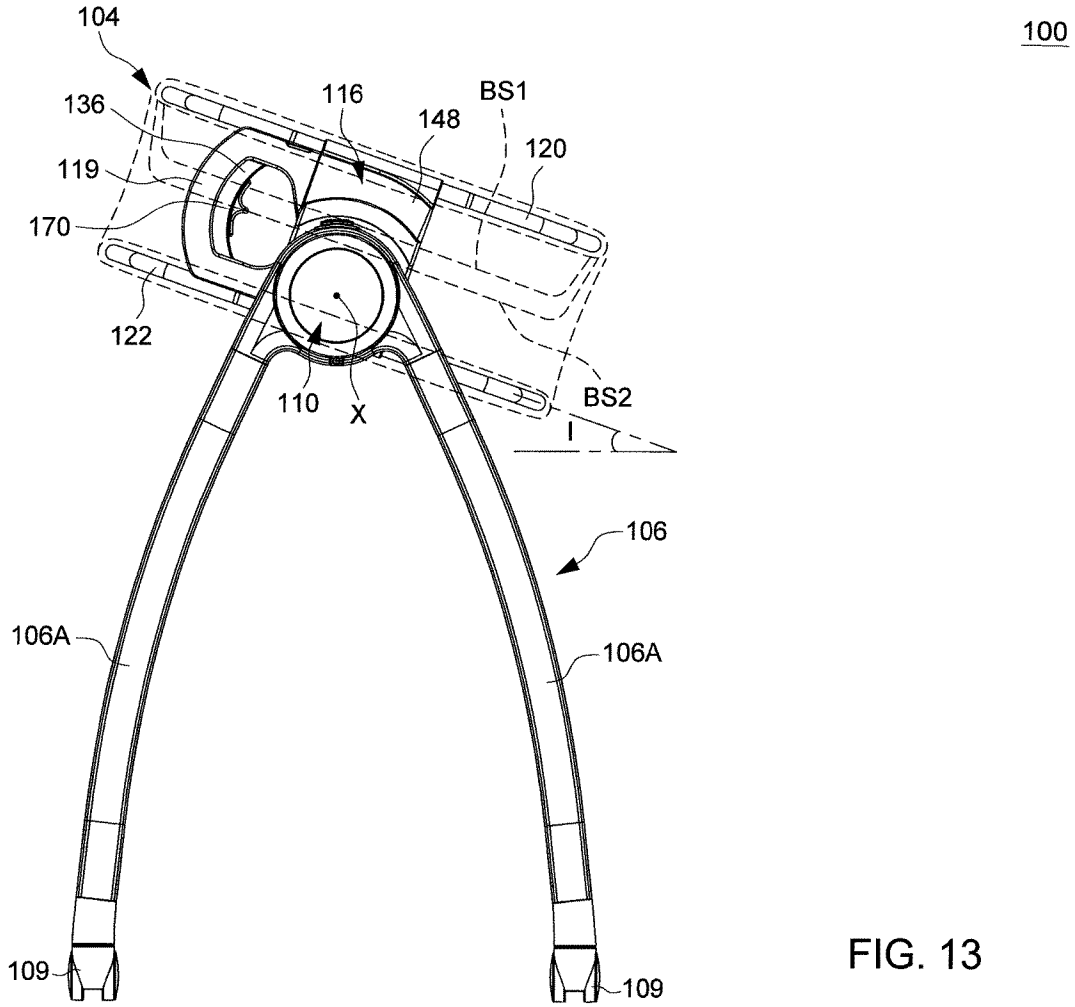
FIG. 13 is a schematic view illustrating an intermediate angular position of the infant resting support between the first and second positions shown in FIGS. 5 and 6.

In case the infant resting support 104 rotates about the pivot axis X in a direction away from the first position shown in FIG. 5 toward the second position shown in FIG. 6, the latch 182 can rotate along with the infant resting support 104 until the infant resting support 104 reaches an intermediate angular position as shown in FIG. 13. This intermediate angular position is between the first and second positions, and corresponds to an inclination of the infant resting support 104 relative to a horizontal plane by an angle I. In one embodiment, the angle I can be between about 10 and about 20 degrees, e.g., 15 degrees. When the infant resting support 104 reaches the intermediate angular position, the biasing action applied by the spring 186 can cause the latch 182 to rotationally switch from the disengaged state to an engaged state engaged with the opening 192 on the joint structure 110 of the support frame 102. While the latch 182 is in the engaged state, the protrusion 182B of the latch 182 can engage with the opening 192 of the joint structure 110, and abut against a stop edge 192A of the opening 192 to block further rotation of the infant resting support 104 from the intermediate angular position toward the second position shown in FIG. 6. As the latch 182 rotates to the engaged state in the intermediate angular position, the ramp surface 182C of the latch 182 also pushes the release actuator 184 from the depressed state to the outwardly protruding state with the operating portion 184B projecting outward with respect to the hub casing 148.

In case the infant resting support 104 is to be further rotated from the intermediate angular position to the second position shown in FIG. 6 (e.g., for positioning the second bearing surface BS2 upward to place a child thereon), a caregiver has to manually press on the operating portion 184B so as to displace the release actuator 184 from the protruding state to the depressed state. As a result, the distal end 184A of the release actuator 184 can come in sliding contact against the ramp surface 182C, and pushes the latch 182 to rotate for disengaging the protrusion 182B from the opening 192 of the joint structure 110. The release actuator 184 can thereby switch the latch 182 from the engaged state to the disengaged state for allowing rotation of the infant resting support 104 from the intermediate angular position to the second position shown in FIG. 6.

When the infant resting support 104 is rotated in a second direction from the second position shown in FIG. 6 toward the first position shown in FIG. 5 (e.g. for placing the first bearing surface BS1 facing upward), the latch 182 is allowed to travel past the opening 192 without obstruction. More specifically, the opening 192 can have a ramp surface 192B opposite to the stop edge 192A, and the latch 182 can be pushed by the ramp surface 192B to self-disengage from the opening 192 as the infant resting support 104 rotates in the second direction past the intermediate angular position. Accordingly, the infant resting support 104 can travel without obstruction in the second direction past the intermediate angular position to the first position.

When the infant resting support 104 is used in the first position shown in FIG. 5 with the first bearing surface BS1 facing upward, the rotation safety lock 180 described herein can prevent or limit accidental rotation of the infant resting support 104 that may cause the child to fall from the infant resting support 104. Accordingly, the infant care apparatus 100 can be safer in use. In case the infant resting support 104 is to be adjusted from the first position to the second position, the release member 136 and the release actuator 184 can be operated concurrently to unlock the latches 132 and 182, such that the infant resting support 104 can rotate continuously past the intermediate angular position to the second position. The placement of the operating portion 184B of the release actuator 184 close to a gripping portion 136A of the release member 136 can facilitate operation: the caregiver can use different fingers of a same hand to operate the release member 136 and the release actuator 184 at the same time.

Figure 14:
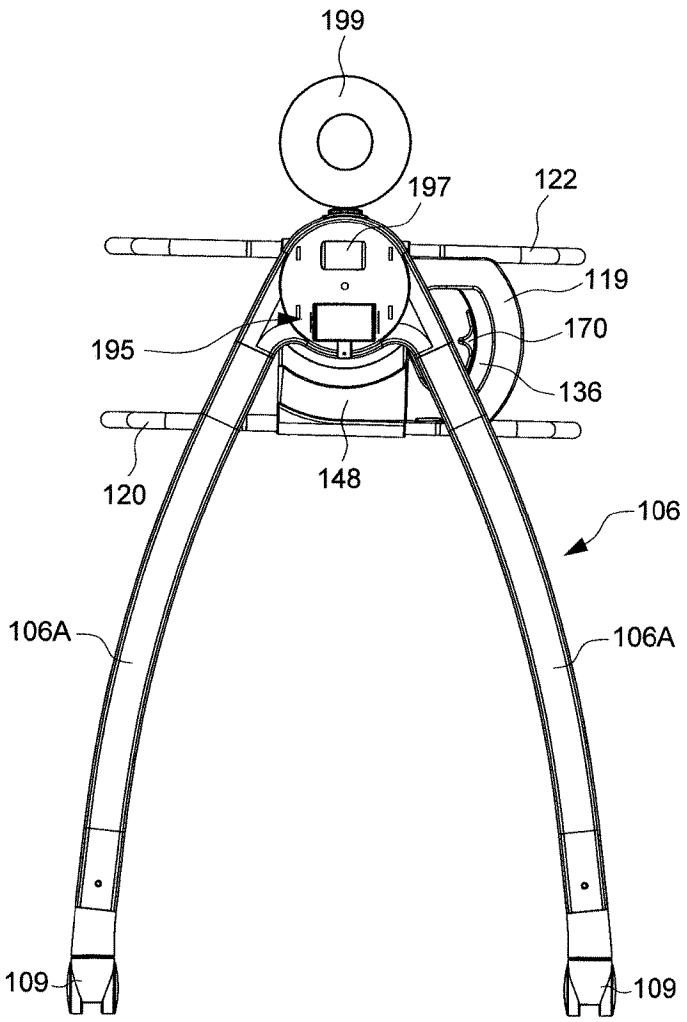
FIG. 14 is a schematic view illustrating an interior of the joint structure provided with a vibrating unit and a battery compartment.
Figure 15:
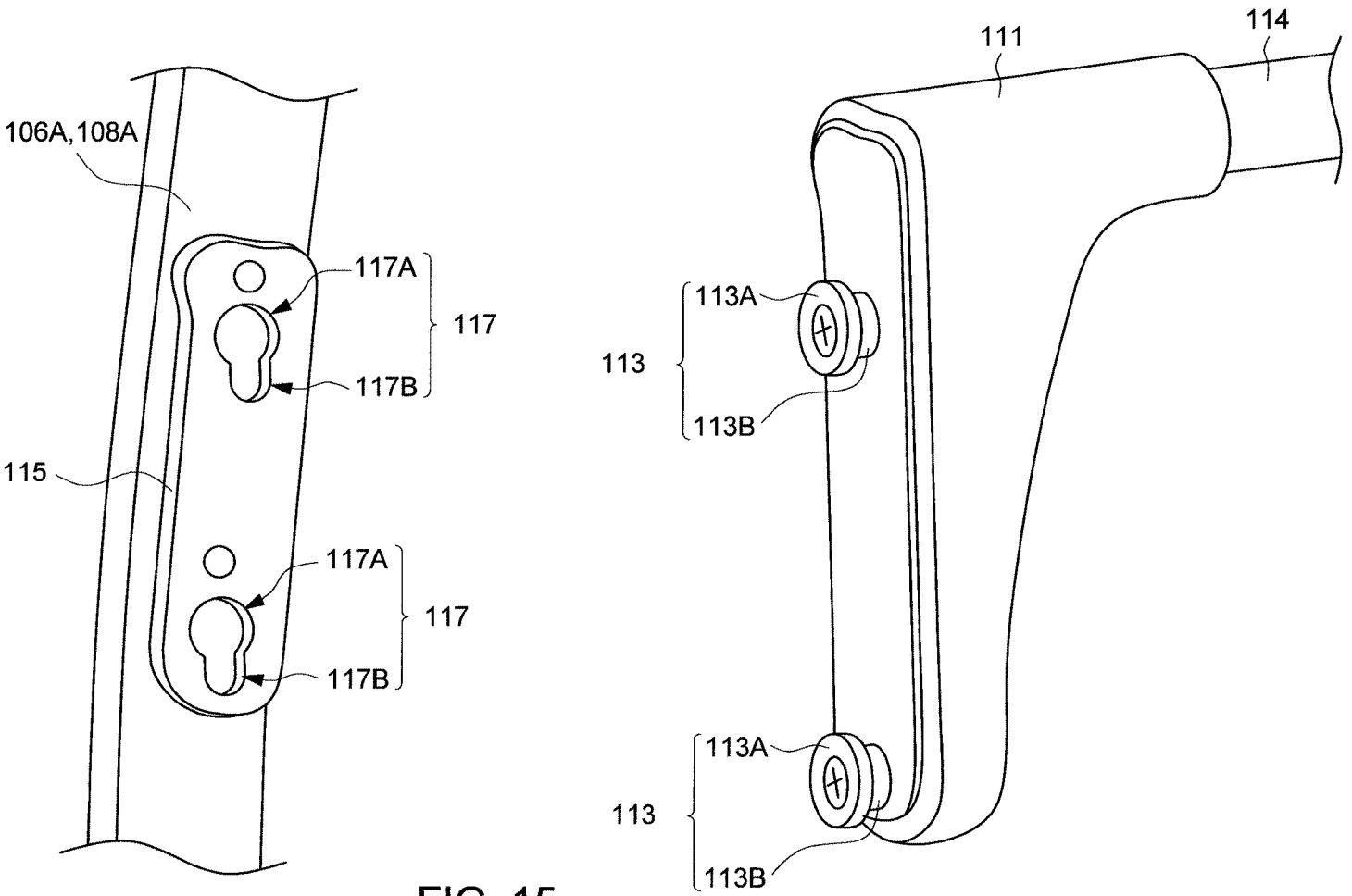
FIG. 15 is a schematic view illustrating an assembly of a support bar for a storage basket with a leg of the infant care apparatus.

Referring to FIGS. 2, 8 and 14, an interior of the joint structure 110 can further have a battery compartment 195 and a space for receiving a vibrating unit 197. The vibrating unit 197 can generate vibration to entertain a child received in the infant resting support 104. The joint structure 110 can be further connected with a movable door 199 operable to open and close the battery compartment 195. In one embodiment, the movable door 199 can have an edge portion pivotally connected with the joint structure 110 about an axis that is substantially parallel to the pivot axis X, so that the movable door 199 can pivot in a plane that is substantially perpendicular to the pivot axis X to open and close the battery compartment 195.

Advantages of the infant care apparatus described herein include the ability to offer different configurations of use according to the needs of a caregiver. The infant care apparatus is convenient to operate for setting each desired configuration of use, and include safety mechanisms that can improve its safety in use.

Realizations of the infant care apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant care apparatus comprising:

a support frame;

an infant resting support having a first and a second bearing surface oriented in different directions, the infant resting support being rotationally connected with the support frame, and each of the first and second bearing surfaces being positionable to face upward for receiving a child thereon, wherein the infant resting support has a first position, a second position, and an angular position between the first and second positions, the first bearing surface facing upward when the infant resting support is in the first position, and the second bearing surface facing upward when the infant resting support is in the second position;

a first latch operable to rotationally lock the infant resting support with respect to the support frame in the first and second positions; and a second latch switchable from a disengaged state to an engaged state to stop the infant resting support in the angular position.

2. The infant care apparatus according to claim 1, wherein the first and second bearing surfaces are opposite to each other.

3. The infant care apparatus according to claim 1, wherein the second latch is operable independently from the first latch.

4. The infant care apparatus according to claim 1, wherein the second latch stops the infant resting support in the angular position when the infant resting support rotates in a first direction from the first position toward the second position, and the second latch allows rotation of the infant resting support in a second direction from the second position past the angular position to the first position.

5. The infant care apparatus according to claim 4, further including a release actuator operable to switch the second latch from the engaged state to the disengaged state, the release actuator being assembled with a hub casing affixed with the infant resting support, the release actuator being in an outwardly protruding state relative to the hub casing when the infant resting support is in the angular position, and the release actuator remaining in a depressed state relative to the hub casing when the infant resting support is at any positions other than the angular position.

6. The infant care apparatus according to claim 5, wherein the release actuator is displaced toward an interior of the hub casing in the depressed state.

7. The infant care apparatus according to claim 5, wherein the release actuator is slidably assembled with the hub casing.

8. The infant care apparatus according to claim 5, wherein the release actuator is spring biased to the depressed state.

9. The infant care apparatus according to claim 5, wherein the second latch is pivotally connected with the hub casing, and the release actuator is slidably connected with the hub casing.

10. The infant care apparatus according to claim 5, wherein the support frame is affixed with a joint structure, the hub casing is pivotally connected with the joint structure about a pivot axis, and the joint structure has an opening eccentric from the pivot axis at a location corresponding to the angular position, an engagement of the second latch with a stop edge of the opening blocking rotation of the infant resting support from the angular position toward the second position.

11. The infant care apparatus according to claim 10, wherein the opening further has a ramp surface at a side opposite to the stop edge, the second latch being pushed by the ramp surface to disengage from the opening as the infant resting support rotates in the second direction past the angular position.

12. The infant care apparatus according to claim 10, wherein the first latch is assembled in the joint structure of the support frame, and the first latch is movable to protrude outside the joint structure to engage with the hub casing.

13. The infant care apparatus according to claim 12, wherein the first latch slides along the pivot axis to engage with the hub casing.

14. The infant care apparatus according to claim 12, wherein the hub casing has a surface provided with two openings and a guide track extending between the two openings, and the first latch includes a first and a second stud spaced apart from each other, the first stud projecting higher than the second stud and being restricted to move along the guide track during rotation of the infant resting support relative to the support frame, and the first and second studs being engagable with the two openings to lock the infant resting support in either of the first and second position.

15. The infant care apparatus according to claim 14, wherein the hub casing further includes two opposite limiting sidewalls respectively arranged adjacent to the two openings, and the first stud is limited to move along the guide track between the two limiting sidewalls during rotation of the infant resting support relative to the support frame.

16. The infant care apparatus according to claim 5, further including a release member that is operably independent from the release actuator to switch the first latch from a locking state to an unlocking state.

17. The infant care apparatus according to claim 16, wherein the release actuator and the release member are respectively assembled with the hub casing.

18. The infant care apparatus according to claim 17, wherein the release member is slidable along a displacement axis relative to the infant resting support, and the release actuator is slidable along an axis tilted an angle relative to the displacement axis.

19. The infant care apparatus according to claim 18, wherein the displacement axis is substantially horizontal when the infant resting support is in the first or second position.

20. The infant care apparatus according to claim 16, further including an impeding part configured to block a displacement of the release member for switching the first latch from the locking state to the unlocking state.

21. The infant care apparatus according to claim 20, wherein the release member is slidable along a displacement axis substantially horizontal when the infant resting support is in the first or second position, and the impeding part is slidable transversally relative to the displacement axis.

22. The infant care apparatus according to claim 1, wherein the angular position corresponds to an angular inclination of the infant resting support relative to a horizontal plane that is between about 10 degrees and about 20 degrees.

23. The infant care apparatus according to claim 1, wherein the infant resting support is pivotally connected with the support frame about a pivot axis, and the first bearing surface is located above the pivot axis when the infant resting support is in the first position.

24. The infant care apparatus according to claim 23, wherein the second bearing surface is located below the pivot axis when the infant resting support is in the second position.

25. The infant care apparatus according to claim 1, wherein the support frame includes:

a first and a second leg spaced apart from each other; and a support bar respectively affixed with the first and second legs below the infant resting support, wherein the support bar has one end affixed with an end connector that has at least one stud, at least the first leg is affixed with a mount socket having at least one aperture, and the at least one aperture has an enlarged opening portion and a narrow opening portion, the at least one stud inserting into the enlarged opening portion of the at least one aperture and sliding downward from the enlarged opening portion to engage with the narrow opening portion of the at least one aperture for assembling the support bar with the first leg.

26. An infant care apparatus comprising:

a support frame;

an infant resting support having a hub casing that is rotationally connected with the support frame, whereby the infant resting support is rotatable about a pivot axis relative to the support frame, the infant resting support having a first and a second bearing surface oriented in different directions, each of the first and second bearing surfaces being positionable to face upward for receiving a child thereon;

a latch assembled with the support frame, the latch being slidable to engage and disengage the hub casing, the latch when engaged with the hub casing rotationally locking the infant resting support with respect to the support frame in any of a first and a second position, the first bearing surface facing upward when the infant resting support is in the first position, and the second bearing surface facing upward when the infant resting support is in the second position; and a release member assembled with the hub casing and operable to urge the latch to disengage from the hub casing, the release member being slidable along a displacement axis that is substantially horizontal when the infant resting support is in the first or second position.

27. The infant care apparatus according to claim 26, wherein the latch is slidable along the pivot axis.

28. The infant care apparatus according to claim 26, wherein the support frame is affixed with a joint structure, and the latch is assembled with the joint structure.

29. The infant care apparatus according to claim 26, wherein the release member is slidable in a plane substantially perpendicular to the pivot axis to urge the latch to disengage from the hub casing.

30. The infant care apparatus according to claim 28, wherein the latch has a knob projecting outside the joint structure toward the hub casing of the infant resting support, and the release member has a ramp surface, the release member being slidable to cause the ramp surface to push against the knob, thereby the latch is urged by the release member to disengage from the hub casing.

31. The infant care apparatus according to claim 30, wherein the ramp surface is at least partially conical in shape.

32. The infant care apparatus according to claim 30, wherein the hub casing has a pivot shaft aligned with the pivot axis that passes through the knob.

33. The infant care apparatus according to claim 32, wherein the latch has two studs located diametrically opposite to each other relative to the pivot axis, and the hub casing has two openings diametrically opposite to each other relative to the pivot axis, the two studs engaging with the two openings to lock the infant resting support in any of the first and second positions.

34. The infant care apparatus according to claim 33, wherein the hub casing further has a guide track extending between the two openings, and two opposite limiting sidewalls respectively arranged adjacent to the two openings, the two studs being a first and a second stud, the first stud projecting higher than the second stud and being restricted to move along the guide track between the two limiting sidewalls during rotation of the infant resting support relative to the support frame.

35. The infant care apparatus according to claim 26, wherein the release member is assembled with an impeding part, and the hub casing is affixed with a rib, the impeding part having a blocking position where the impeding part abuts against the rib to block sliding of the release member in a direction for switching the latch from a locking state to an unlocking state, and the impeding part being movable relative to the release member in any of two opposite directions away from the blocking position to allow displacement of the release member in the direction for switching the latch from the locking state to the unlocking state.

36. The infant care apparatus according to claim 35, wherein the impeding part is slidable relative to the release member in two opposite directions along an axis that extends transversally relative to a displacement axis of the release member.

37. The infant care apparatus according to claim 36, wherein the axis along which the impeding part is movable extends generally up and down when the infant resting support is in any of the first and second positions.

38. The infant care apparatus according to claim 36, wherein the impeding part is connected with two springs, the two springs being operable to bias the impeding part toward the blocking position.

39. The infant care apparatus according to claim 26, wherein the infant resting support includes two rigid frame portions arranged parallel and offset from each other, the hub casing being affixed with the two rigid frame portions, and the release member being arranged between the two rigid frame portions.

40. The infant care apparatus according to claim 39, wherein the hub casing has a grip portion located between the two rigid frame portions, and the release member is arranged adjacent to the grip portion.

41. The infant care apparatus according to claim 28, wherein the joint structure has a battery compartment and a space for receiving a vibrating unit, the joint structure being further assembled with a movable door operable to open and close the battery compartment.

42. The infant care apparatus according to claim 26, wherein the support frame includes:

a first and a second leg spaced apart from each other; and a support bar respectively affixed with the first and second legs below the infant resting support, wherein the support bar has one end affixed with an end connector that has at least one stud, at least the first leg is affixed with a mount socket having at least one aperture, and the at least one aperture has an enlarged opening portion and a narrow opening portion, the at least one stud inserting into the enlarged opening portion and sliding downward from the enlarged opening portion to engage with the narrow opening portion of the at least one aperture for assembling the support bar with the first leg.

* * * * *